US012292042B2

(12) United States Patent
Wu

(10) Patent No.: US 12,292,042 B2
(45) Date of Patent: May 6, 2025

(54) FLOOR PUMP

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 155 days.

(21) Appl. No.: 18/302,907

(22) Filed: Apr. 19, 2023

(65) Prior Publication Data

US 2023/0407857 A1 Dec. 21, 2023

(30) Foreign Application Priority Data

Jun. 20, 2022 (TW) ..... 111206482

(51) Int. Cl.
*F04B 33/00* (2006.01)
*F04B 39/00* (2006.01)

(52) U.S. Cl.
CPC ..... *F04B 33/00* (2013.01); *F04B 39/00* (2013.01)

(58) Field of Classification Search
CPC ..... F04B 39/00; F04B 33/00; F04B 33/005
See application file for complete search history.

(56) References Cited

U.S. PATENT DOCUMENTS 1,356,857 A * 10/1920 Ellis ..... F04B 33/005 92/138
1,408,859 A * 3/1922 Brandt ..... F04B 33/005 248/346.3
1,441,829 A * 1/1923 Brandt ..... F04B 33/00 92/240
1,453,178 A * 4/1923 Petry ..... F04B 33/005 92/23
2004/0156726 A1* 8/2004 Wu ..... F04B 33/005 417/469
2011/0091339 A1* 4/2011 Huang ..... F04B 33/005 417/437
2019/0128255 A1* 5/2019 Wang ..... F04B 53/10

FOREIGN PATENT DOCUMENTS

GB 240601 A * 10/1928
TW I620870 B 4/2018

* cited by examiner

*Primary Examiner* — Connor J Tremarche
(74) *Attorney, Agent, or Firm* — MUNCY, GEISSLER, OLDS & LOWE, P.C.

(57) ABSTRACT

A floor pump includes an inflation device having a pump, a seat, and a pressure gauge. The seat is connected to a lower edge of the pump. The pressure gauge is connected between two ends of the pump. A base is pivotably connected to the seat and is movable between an extended position and a first folded position. The base includes first and second footrest portions located on two opposite sides of the seat. When the base is in the extended position, both the first footrest portion and the second footrest portion are not located below the pressure gauge. When the base is in the first folded position, the first footrest portion is located below the pressure gauge.

8 Claims, 12 Drawing Sheets

FLOOR PUMP

BACKGROUND OF THE INVENTION

The present invention relates to an inflation pump and, more particularly, to a floor pump.

Taiwan Invention Patent No. 1620870 entitled "QUICK-TO-ASSEMBLE FLOOR PUMP" discloses an inflation pump including a base, a cylinder connected to the base, a hose connected to the base, and an intercommunicating device extending through the base and the cylinder. The base includes a first through-hole. The cylinder includes a second through-hole and a piston rod slidably received in the cylinder. The hose is adapted to connect with an object to be inflated. The intercommunicating device extends through the first through-hole of the base and the second through-hole of the cylinder. The intercommunicating device includes an air passageway intercommunicating the cylinder with the hose. Air in the cylinder pressurized by the piston rod can enter the hose via the air passageway.

To avoid the appearance of the inflation pump from being damaged during transportation, the inflation pump must be independently packaged for transportation. The resultant volume for transportation of the inflation pump after packaging is equal to the length of the base times the width of the base times the overall height of the cylinder and the piston rod, which contains considerable useless space. This is because the area of the base is far greater than the cross sectional area of the cylinder so as to allow the inflation pump to stably stand on the ground. The above floor pump and currently existing floor pumps have the same problem.

In view of the shortcoming of the above conventional structure, the present inventor has designed a floor pump to overcome the drawbacks of the conventional structure.

SUMMARY OF THE INVENTION

An objective of the present invention is to provide a floor pump A floor pump includes an inflation device and a base. The inflation device includes a pump, a seat, and a pressure gauge. The pump extends in a vertical direction. The seat is connected to a lower edge of the pump in the vertical direction. The pressure gauge is disposed in a horizontal direction and is connected between two ends of the pump in the vertical direction. The base is pivotably connected to the seat and movable between an extended position and a first folded position. The base includes a first footrest portion and a second footrest portion. The first footrest portion and the second footrest portion are located on two opposite sides of the seat. When the base is in the extended position, both the first footrest portion and the second footrest portion are not located below the pressure gauge in the vertical direction. When the base is in the first folded position, the first footrest portion is located below the pressure gauge in the vertical direction. By the above structure, the volume of the floor pump can be reduced for transportation.

In an example, the base is movable relative to the seat between an extended position and a second folded position. When the base is in the second folded position, the second footrest portion is located below the pressure gauge in the vertical direction.

In an example, the seat includes an outer periphery having a coupling protrusion protruding outward in the horizontal direction. An upper edge of the base in the vertical direction includes a first coupling groove and a second coupling groove. The first coupling groove is disposed between the first footrest portion and the seat. The second coupling groove is disposed between the second footrest portion and the seat. When the base is in the first extended position, the coupling protrusion abuts against an outer periphery of the base in the horizontal direction. When the base is in the first folded position, the coupling protrusion is coupled in the first coupling groove. When the base is in the second folded position, the coupling protrusion is coupled in the second coupling groove.

In an example, a fastener is connected to the lower edge of the seat in the vertical direction. The base includes a pivotal hole. The fastener extends from a side of the base opposite to the seat through the pivotal hole and is in threading connection with the seat. The base is pivotable about the fastener between the extended position and the first folded position or between the extended position and the second folded position. When the fastener is tightened, the base is retained in the extended position, the first folded position, or the second folded position.

In an example, the lower edge of the seat in the vertical direction includes two first positioning protrusions and two second positioning protrusions. The two first positioning protrusions and the two second positioning protrusions are equiangularly spaced from each other and around the fastener. The two first positioning protrusions are disposed on two opposite sides of the fastener. The two first positioning protrusions and the fastener are on the same line. The two second positioning protrusions are disposed on two opposite sides of the fastener. The two second positioning protrusions and the fastener are on the same line. The upper edge of the base in the vertical direction includes two first positioning holes and two second positioning holes. The two first positioning holes and the two second positioning holes are equiangularly spaced from each other and around the pivotal hole. When the base is in the extended position, the two first positioning protrusions are respectively coupled in the two first positioning holes, and the two second positioning protrusions are respectively coupled in the two second positioning holes. When the base is in the first folded position or the second folded position, the two first positioning protrusions are respectively coupled in the two second positioning holes, and the two second positioning protrusions are respectively coupled in the two first positioning holes.

In an example, the lower edge of the seat in the vertical direction includes a positioning stub. The base includes a pivotal hole. The positioning stub extends through the pivotal hole. The base is pivotable about the positioning stub between the extended position and the first folded position or between the extended position and the second folded position. The inflation device includes a lever disposed on a side of the base opposite to the seat and is pivotably mounted to the positioning stub. When the lever is in a tightened state, the lever presses against the base to retain the base in the extended position, the first folded position, or the second folded position.

In an example, the lower edge of the seat in the vertical direction includes two first positioning protrusions and two second positioning protrusions. The two first positioning protrusions and the two second positioning protrusions are equiangularly spaced from each other and around the positioning stub. The two first positioning protrusions are disposed on two opposite sides of the positioning stub. The two first positioning protrusions and the positioning stub are on the same line. The two second positioning protrusions are disposed on two opposite sides of the positioning stub. The two second positioning protrusions and the positioning stub are on the same line. The upper edge of the base in the vertical direction includes two first positioning holes and two second positioning holes. The two first positioning holes and the two second positioning holes are equiangularly spaced from each other and around the pivotal hole. When the base is in the extended position, the two first positioning protrusions are respectively coupled in the two first positioning holes, and the two second positioning protrusions are respectively coupled in the two second positioning holes. When the base is in the first folded position or the second folded position, the two first positioning protrusions are respectively coupled in the two second positioning holes, and the two second positioning protrusions are respectively coupled in the two first positioning holes.

In an example, the seat includes two receptacles, two elastic elements, and two pressing members. The two receptacles are disposed in the lower edge of the seat in the vertical direction. The two elastic elements are respectively received in the two receptacles. The two pressing members are respectively received in the two receptacles. Each of the two pressing members includes an end abutting against the seat and another end abutting against an associated pressing member. An end of each pressing member opposite to an associated elastic element abuts against the upper edge of the base in the vertical direction.

In an example, the inflation device includes an intercommunicating axle and an inflation tube. The intercommunicating axle is inserted into the seat in the horizontal direction and extends through the pump. The pressure gauge is connected to an intercommunicating tube. An end of the intercommunicating tube opposite to the pressure gauge is mounted around the intercommunicating axle and is adjacent to the seat. The inflation tube is in threading connection with an end of the intercommunicating axle and is located on a side of the intercommunicating tube opposite to the seat. The pump, the pressure gauge, and the inflation tube intercommunicate with each other.

In an example, the pump includes a cylinder and a bottom plug. The bottom plug is disposed in an end of the cylinder. The end of the cylinder is disposed in the seat. The intercommunicating axle is disposed in the seat and extends through the cylinder and the bottom plug.

The present invention will become clearer in light of the following detailed description of illustrative embodiments of this invention described in connection with the drawings.

DETAILED DESCRIPTION OF THE INVENTION

Figure 1:
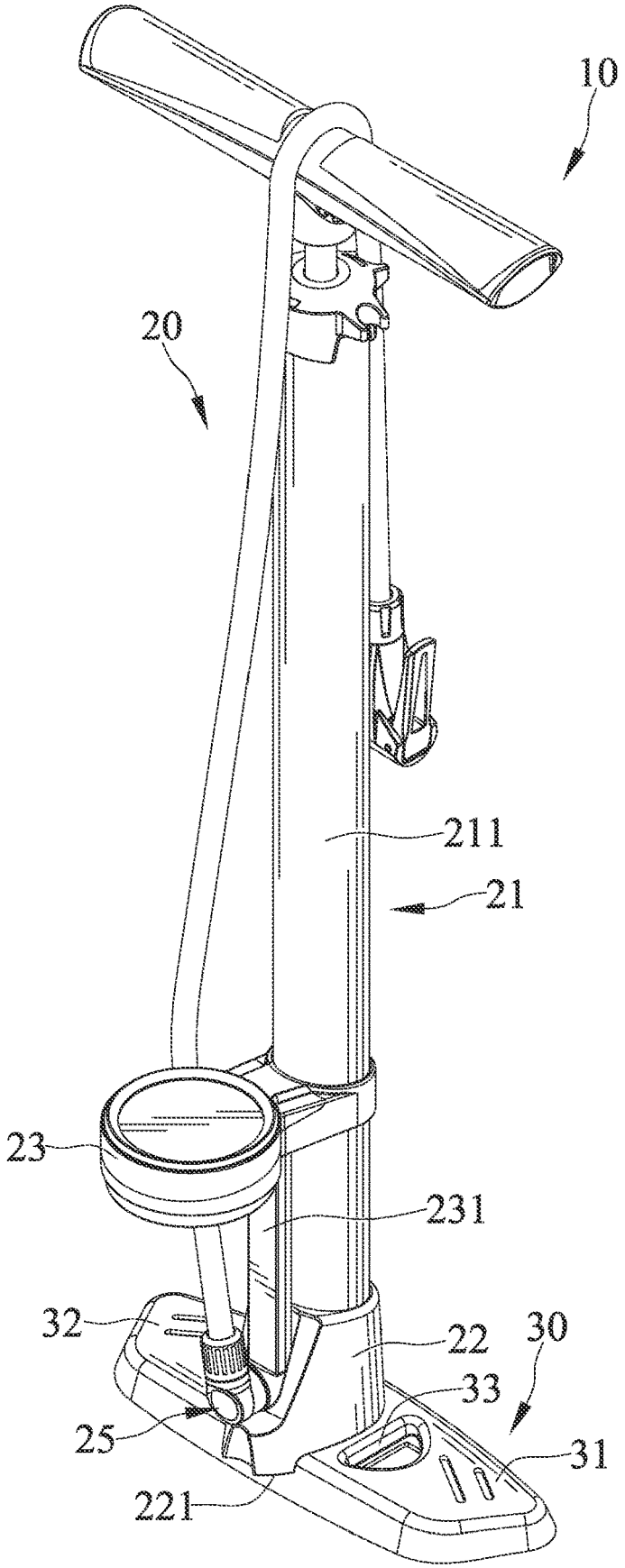
FIG. 1 is a perspective view of a floor pump of a first embodiment according to the present invention.
Figure 2:
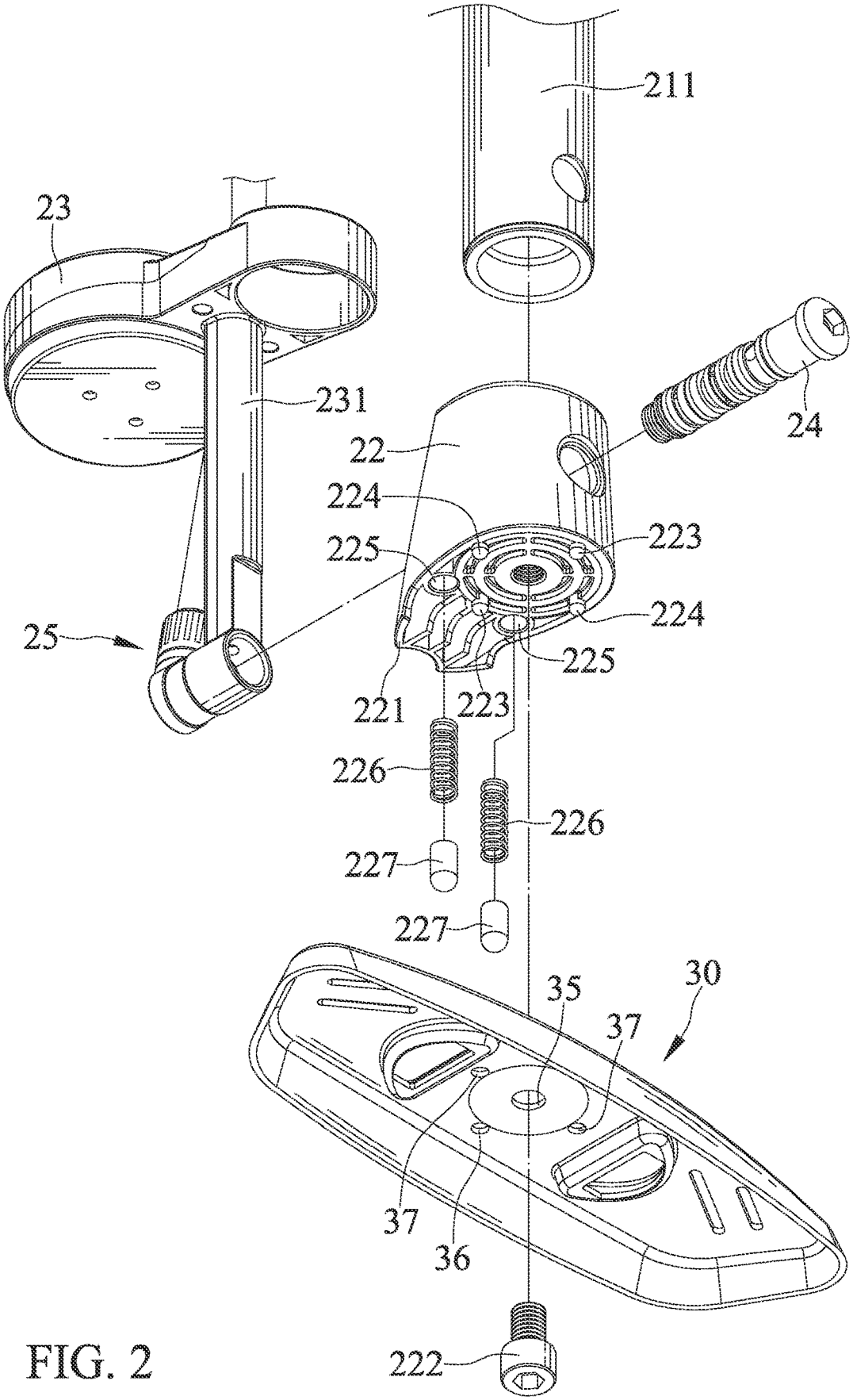
FIG. 2 is a partial, exploded, perspective view of the floor pump of the first embodiment according to the present invention.
Figure 3:
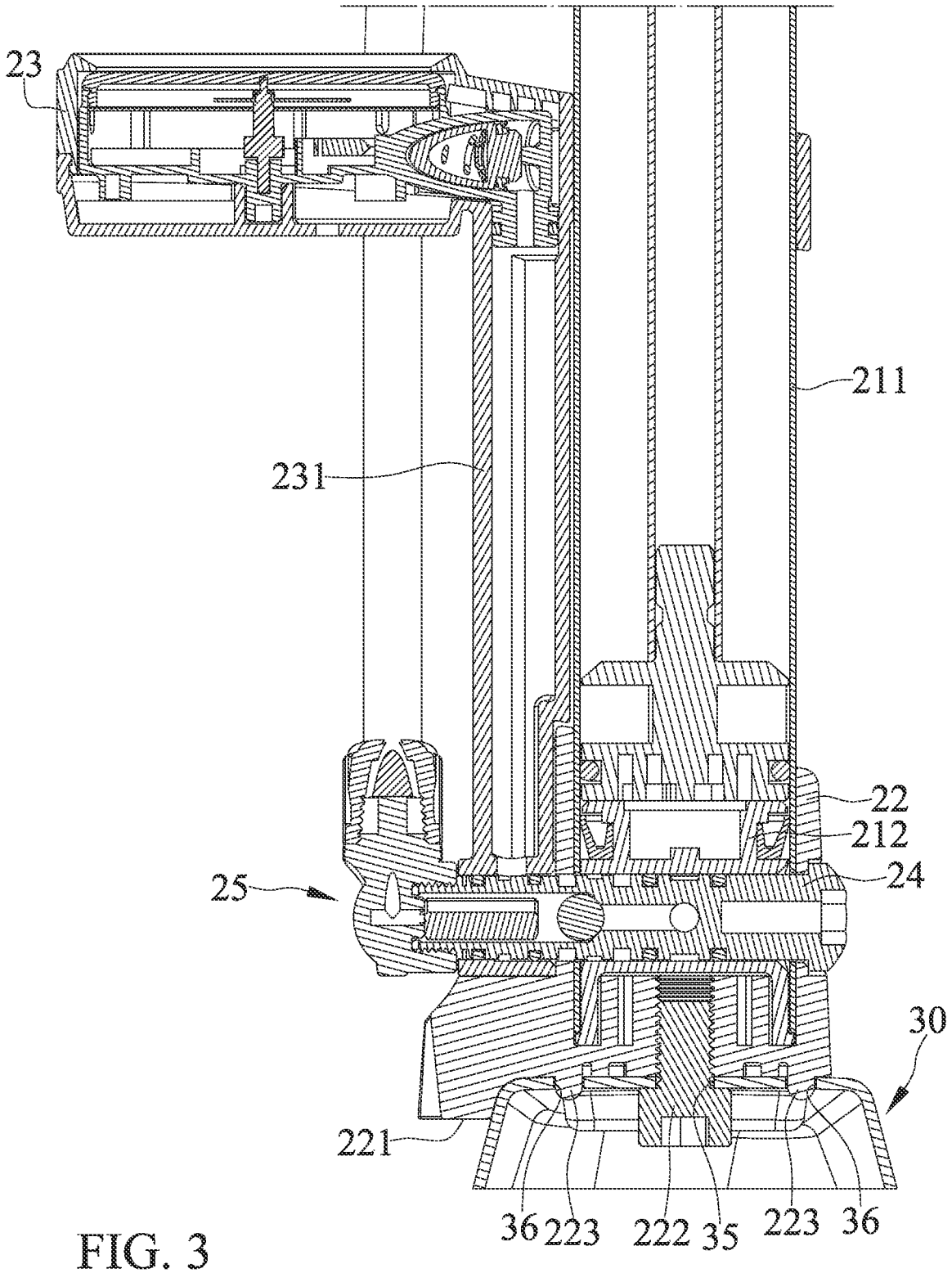
FIG. 3 is a partial, cross sectional view of the floor pump of the first embodiment according to the present invention, with a base of the floor pump in an extended position.
Figure 4:
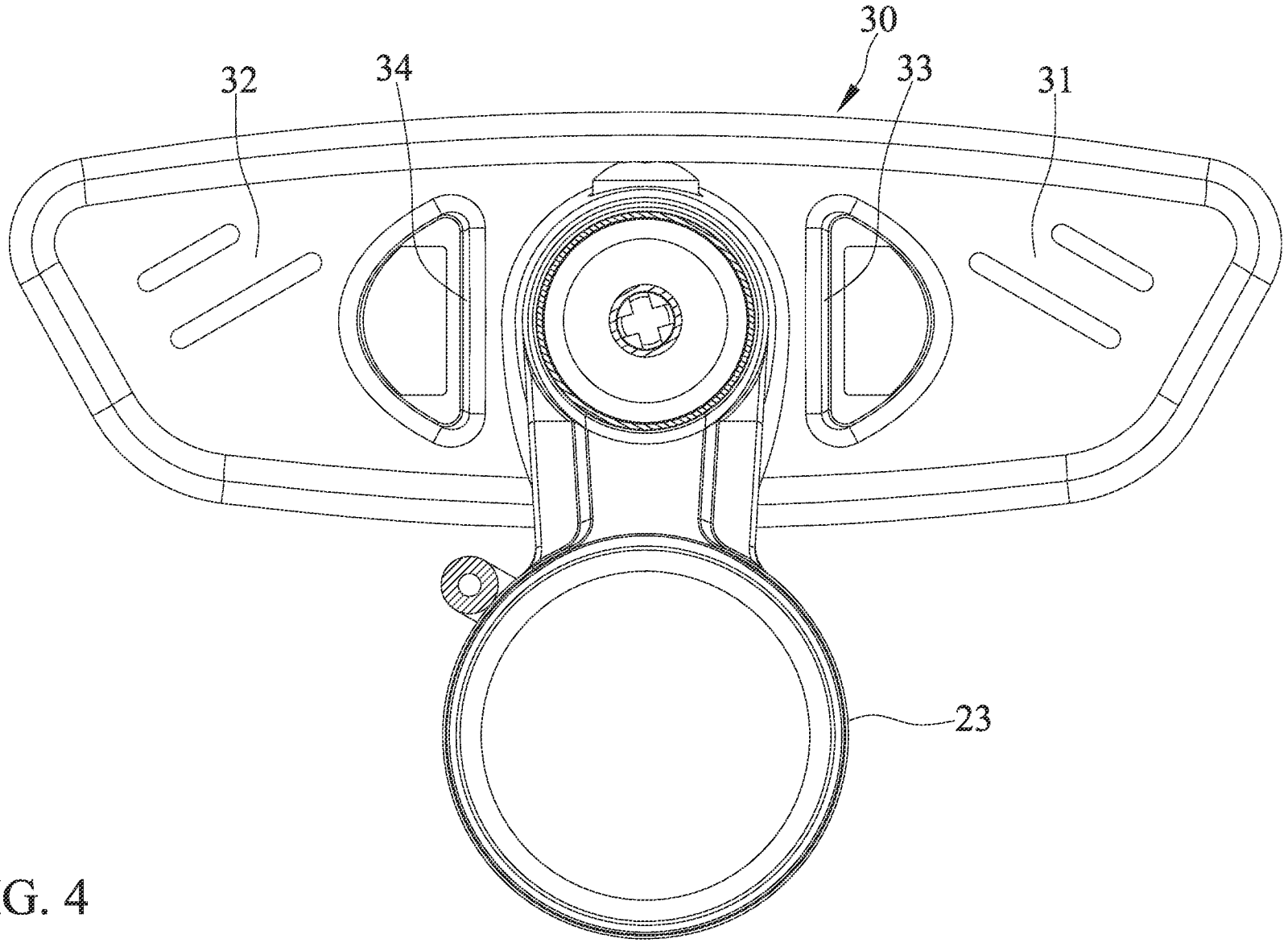
FIG. 4 is a top view of the floor pump of the first embodiment according to the present invention, with the base in an extended position.
Figure 5:
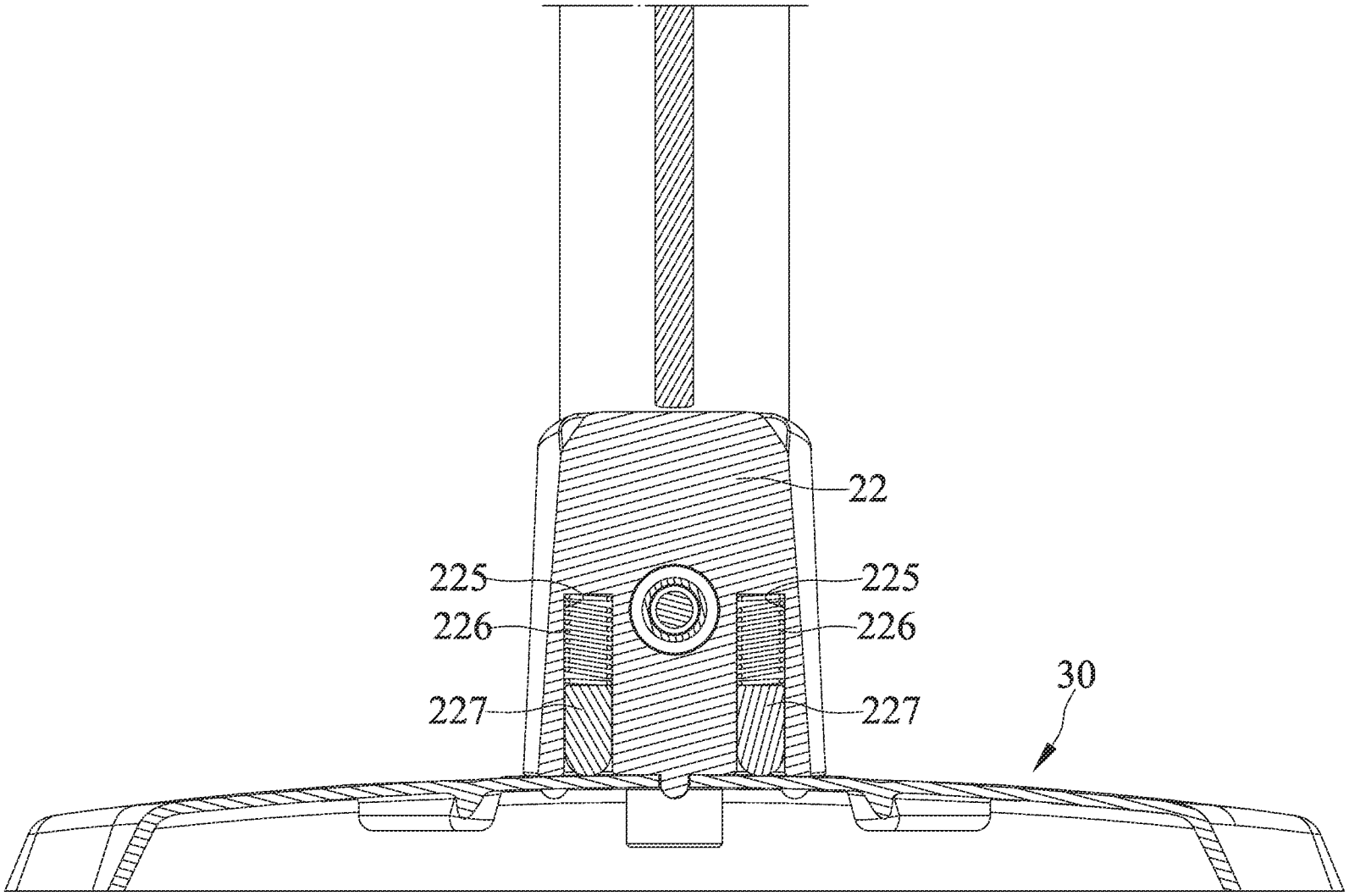
FIG. 5 is a cross sectional view illustrating a pressing member of the floor pump of the first embodiment according to the present invention.
Figure 6:
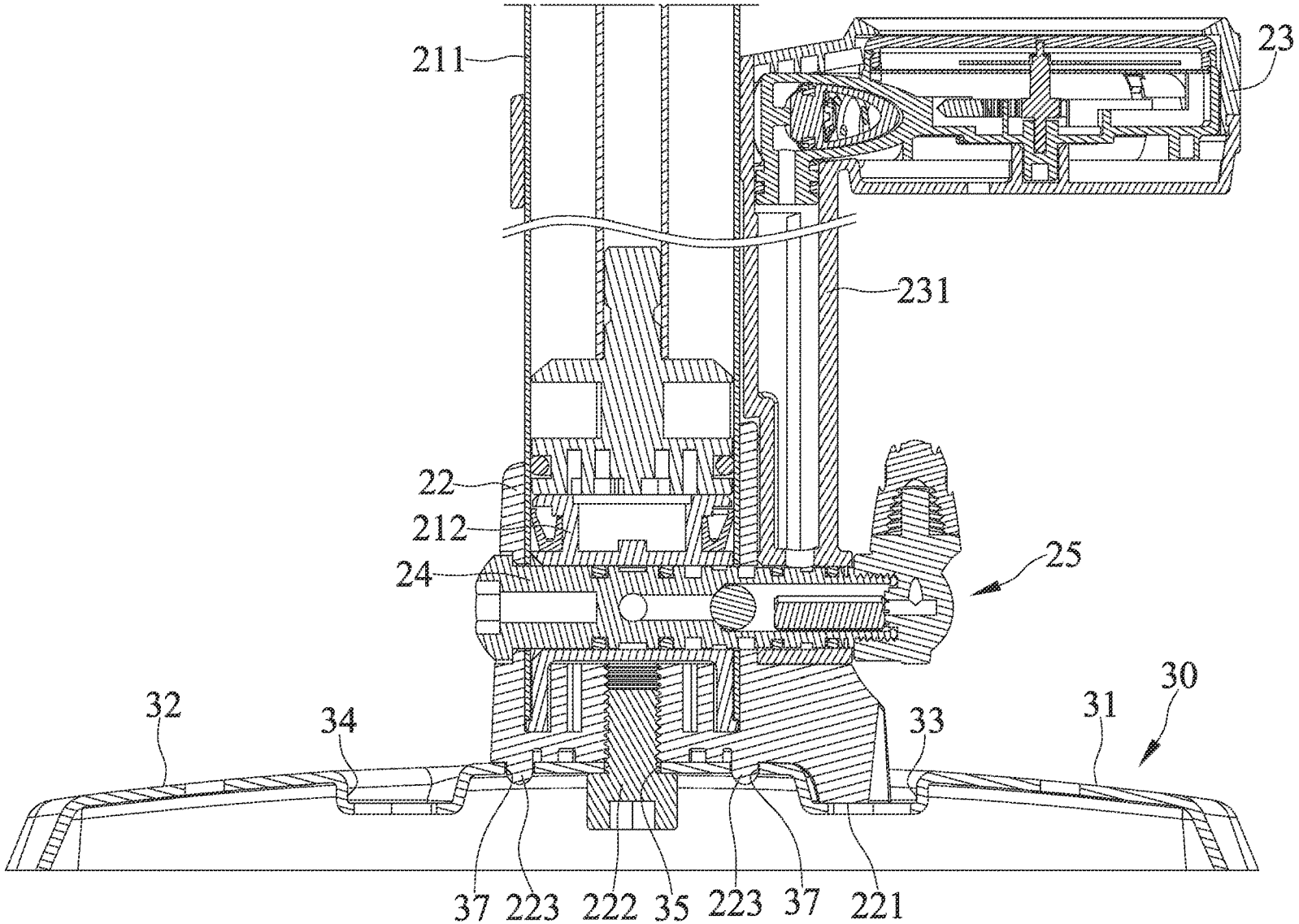
FIG. 6 is a cross sectional view illustrating the base of the floor pump of the first embodiment according to the present invention in a first folded position.
Figure 7:
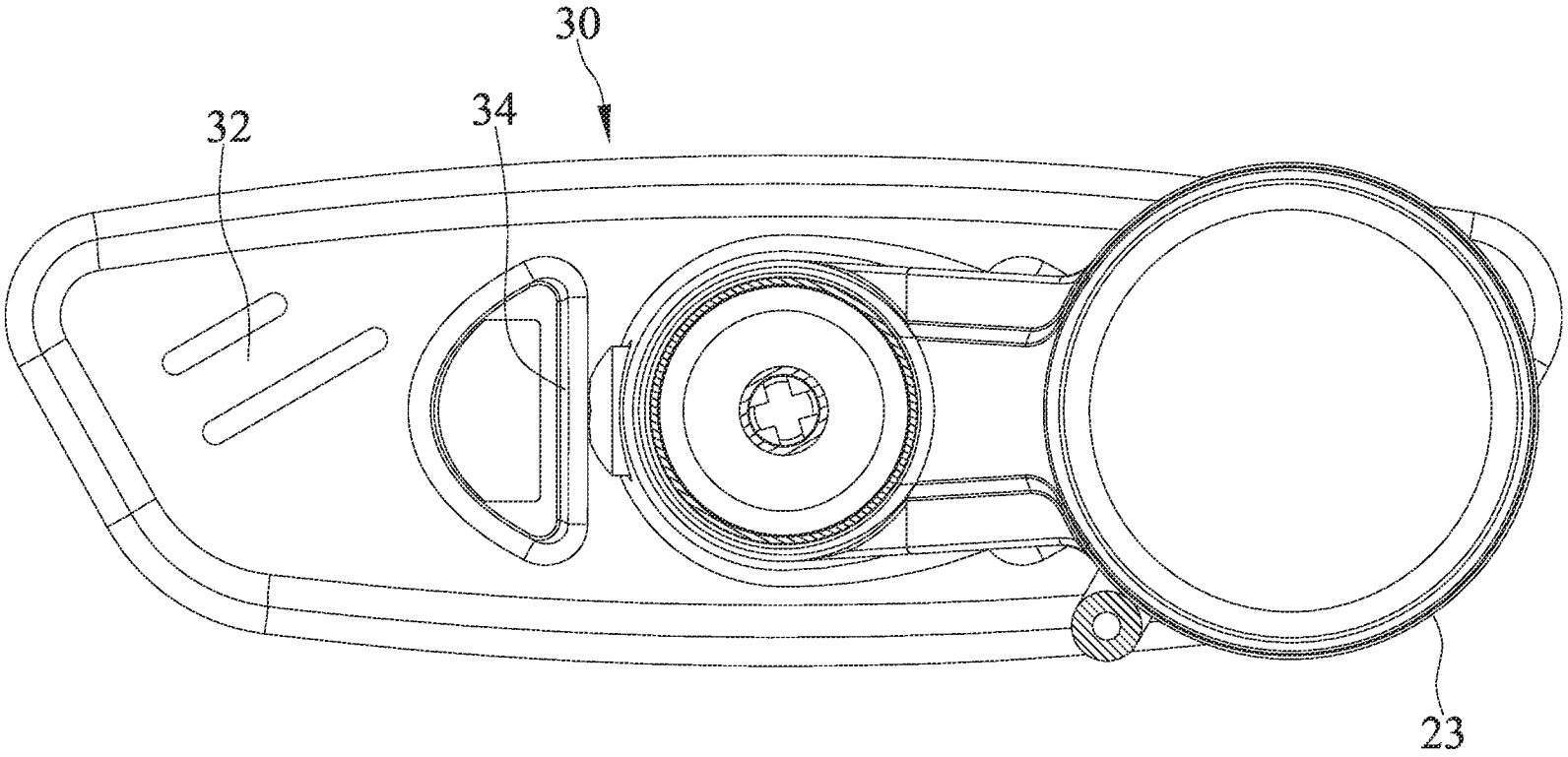
FIG. 7 is a top view illustrating the base of the floor pump of the first embodiment according to the present invention in the first folded position.
Figure 8:
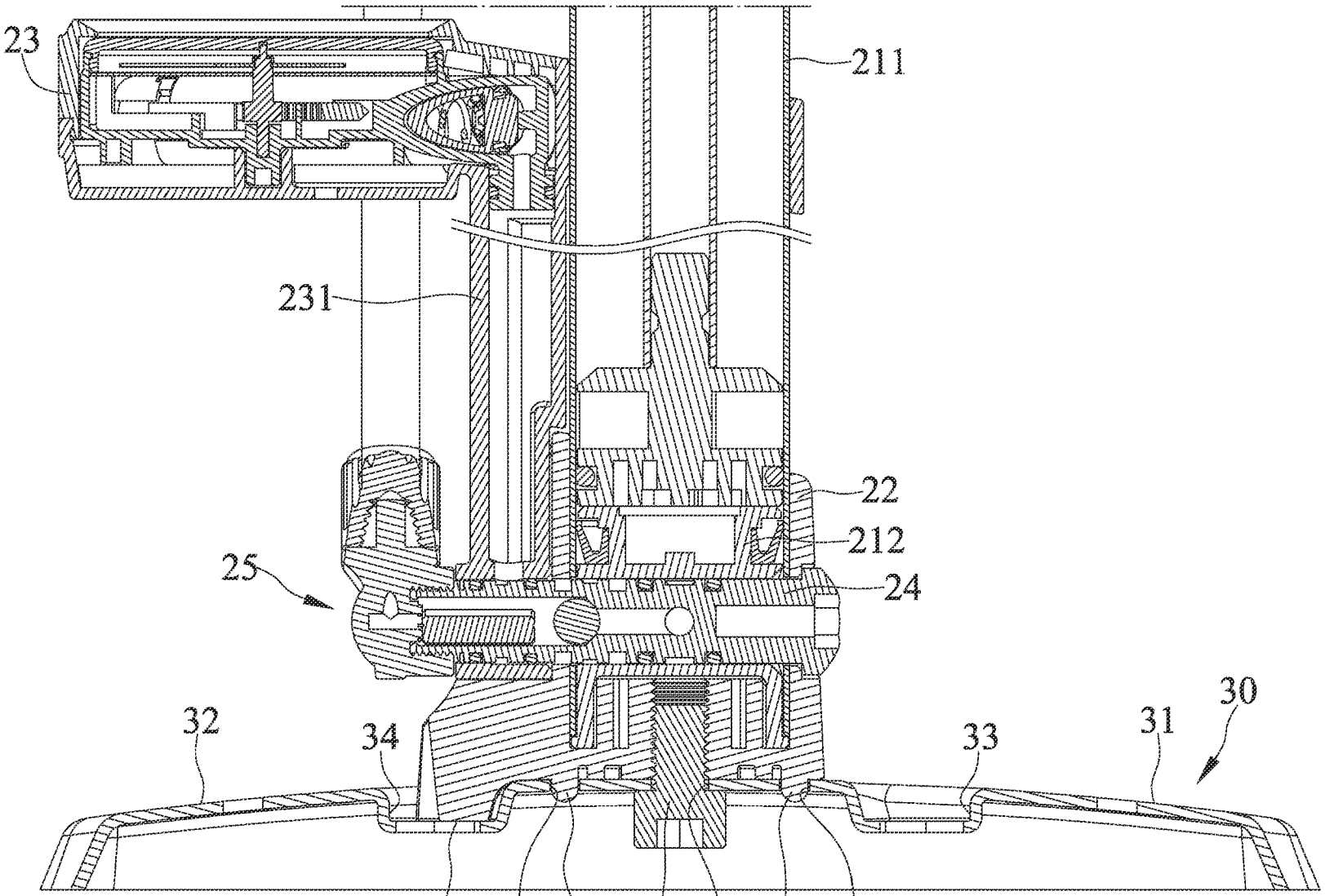
FIG. 8 is a cross sectional view illustrating the base of the floor pump of the first embodiment according to the present invention in a second folded position.
Figure 9:
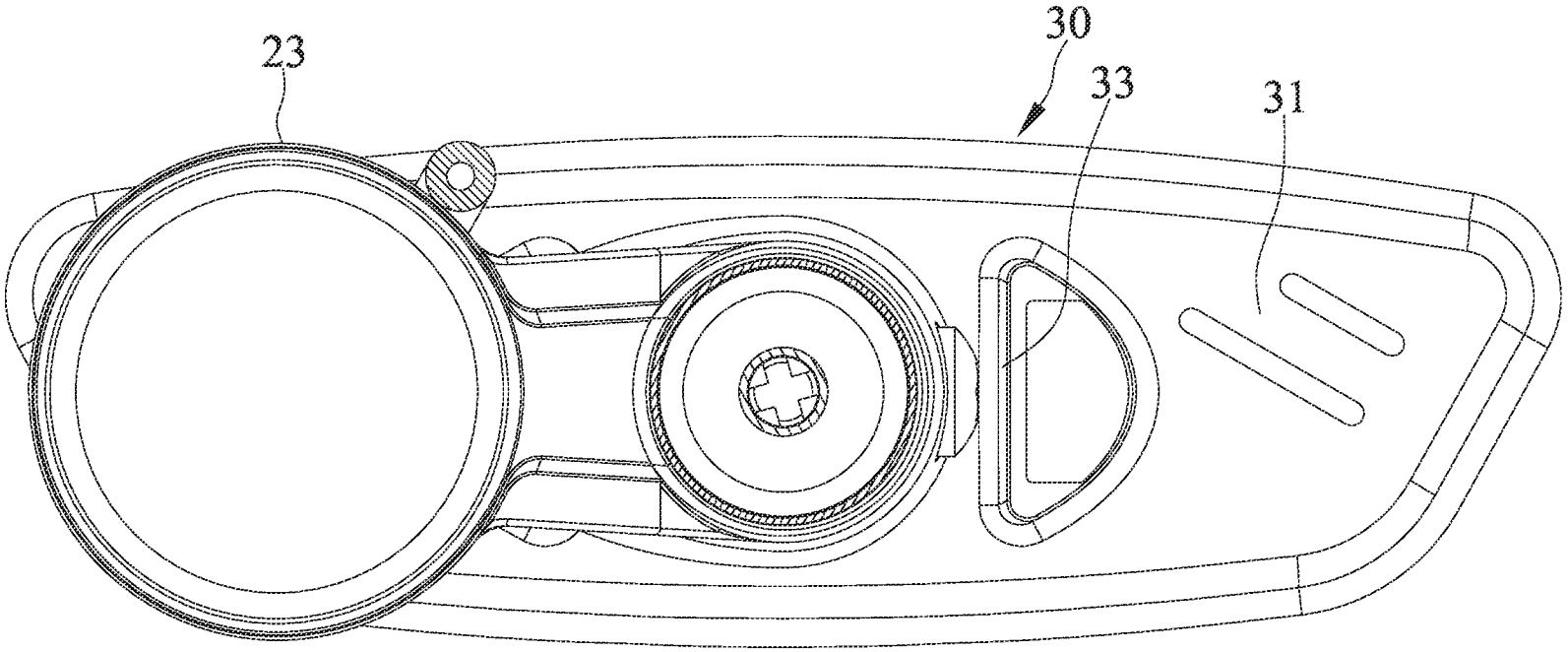
FIG. 9 is a top view illustrating the base of the floor pump of the first embodiment according to the present invention in the second folded position.

The techniques, measures, and effects of present invention will hereinafter set forth in detail by two preferred embodiments described in connection with the drawings. The description is provided for the purpose of explanation only, and the application for patent shall not be restricted by such structures.

FIGS. 1-9 illustrate a perspective view, an exploded-perspective view, and cross sectional views of a floor pump 10 of a first embodiment according to the present invention. The floor pump 10 according to the present invention comprises an inflation device 20 and a base 30.

The inflation device 20 includes a pump 21, a seat 22, and a pressure gauge 23. The pump 21 extends in a vertical direction. The seat 22 is connected to a lower edge of the pump 21 in the vertical direction. The pressure gauge 23 is disposed in a horizontal direction and is connected between two ends of the pump 21 in the vertical direction.

The base 30 is pivotably connected to the seat 22 and is movable between an extended position and a first folded position. The base 30 includes a first footrest portion 31 and a second footrest portion 32. The first footrest portion 31 and the second footrest portion 32 are located on two opposite sides of the seat 22. When the base 30 is in the extended position, both the first footrest portion 31 and the second footrest portion 32 are not located below the pressure gauge 23 in the vertical direction. When the base 30 is in the first folded position, the first footrest portion 31 is located below the pressure gauge 23 in the vertical direction.

The base 30 may also be movable relative to the seat 22 between an extended position and a second folded position. When the base 30 is in the second folded position, the second footrest portion 32 is located below the pressure gauge 23 in the vertical direction.

The seat 22 includes an outer periphery having a coupling protrusion 221 protruding outward in the horizontal direction. An upper edge of the base 30 in the vertical direction includes a first coupling groove 33 and a second coupling groove 34. The first coupling groove 33 is disposed between the first footrest portion 31 and the seat 22. The second coupling groove 34 is disposed between the second footrest portion 32 and the seat 22. When the base 30 is in the first extended position, the coupling protrusion 221 abuts against an outer periphery of the base 30 in the horizontal direction. When the base 30 is in the first folded position, the coupling protrusion 221 is coupled in the first coupling groove 33. When the base 30 is in the second folded position, the coupling protrusion 221 is coupled in the second coupling groove 34.

A fastener 222 is connected to the lower edge of the seat 22 in the vertical direction. The base 30 includes a pivotal hole 35. The fastener 222 extends from a side of the base 30 opposite to the seat 22 through the pivotal hole 35 and is in threading connection with the seat 22. The base 30 is pivotable about the fastener 222 between the extended position and the first folded position or between the extended position and the second folded position. When the fastener 222 is tightened, the base 30 is retained in the extended position, the first folded position, or the second folded position.

The lower edge of the seat 22 in the vertical direction includes two first positioning protrusions 223 and two second positioning protrusions 224. The two first positioning protrusions 223 and the two second positioning protrusions 224 are equiangularly spaced from each other and around the fastener 222. The two first positioning protrusions 223 are disposed on two opposite sides of the fastener 222. The two first positioning protrusions 223 and the fastener 222 are on the same line. The two second positioning protrusions 224 are disposed on two opposite sides of the fastener 222. The two second positioning protrusions 224 and the fastener 222 are on the same line. The upper edge of the base 30 in the vertical direction includes two first positioning holes 36 and two second positioning holes 37. The two first positioning holes 36 and the two second positioning holes 37 are equiangularly spaced from each other and around the pivotal hole 35. When the base 30 is in the extended position, the two first positioning protrusions 223 are respectively coupled in the two first positioning holes 36, and the two second positioning protrusions 224 are respectively coupled in the two second positioning holes 37. When the base 30 is in the first folded position or the second folded position, the two first positioning protrusions 223 are respectively coupled in the two second positioning holes 37, and the two second positioning protrusions 224 are respectively coupled in the two first positioning holes 36.

The seat 22 includes two receptacles 225, two elastic elements 226, and two pressing members 227. The two receptacles 225 are disposed in the lower edge of the seat 22 in the vertical direction. The two elastic elements 226 are respectively received in the two receptacles 225. The two pressing members 227 are respectively received in the two receptacles 225. Each of the two pressing members 227 includes an end abutting against the seat 22 and another end abutting against an associated pressing member 227. An end of each pressing member 227 opposite to an associated elastic element 226 abuts against the upper edge of the base 30 in the vertical direction.

The inflation device 20 includes an intercommunicating axle 24 and an inflation tube 25. The intercommunicating axle 24 is inserted into the seat 22 in the horizontal direction and extends through the pump 21. The pressure gauge 23 is connected to an intercommunicating tube 231. An end of the intercommunicating tube 231 opposite to the pressure gauge 23 is mounted around the intercommunicating axle 24 and is adjacent to the seat 22. The inflation tube 25 is in threading connection with an end of the intercommunicating axle 24 and is located on a side of the intercommunicating tube 231 opposite to the seat 22. The pump 21, the pressure gauge 23, and the inflation tube 25 intercommunicate with each other.

The pump 21 includes a cylinder 211 and a bottom plug 212. The bottom plug 212 is disposed in an end of the cylinder 211. The end of the cylinder 211 is disposed in the seat 22. The intercommunicating axle 24 is disposed in the seat 22 and extends through the cylinder 211 and the bottom plug 212.

By the above structure, the floor pump 10 can reduce the volume for transportation. During transportation of the floor pump 10, the base 30 can be pivoted to the first folded position or the second folded position. The pressure gauge 23 and the base 30 in the package can be kept parallel to each other to reduce the occupation space. Reduction in the volume of the package of the floor pump 10 can significantly reduce the transportation costs. Furthermore, a user can pivot the base 30 to a ready-to-use state by simple movement. Since the operation is easy, the user can pivot the base 30 to the first folded position or the second folded position to save the space for storage in daily use.

Figure 10:
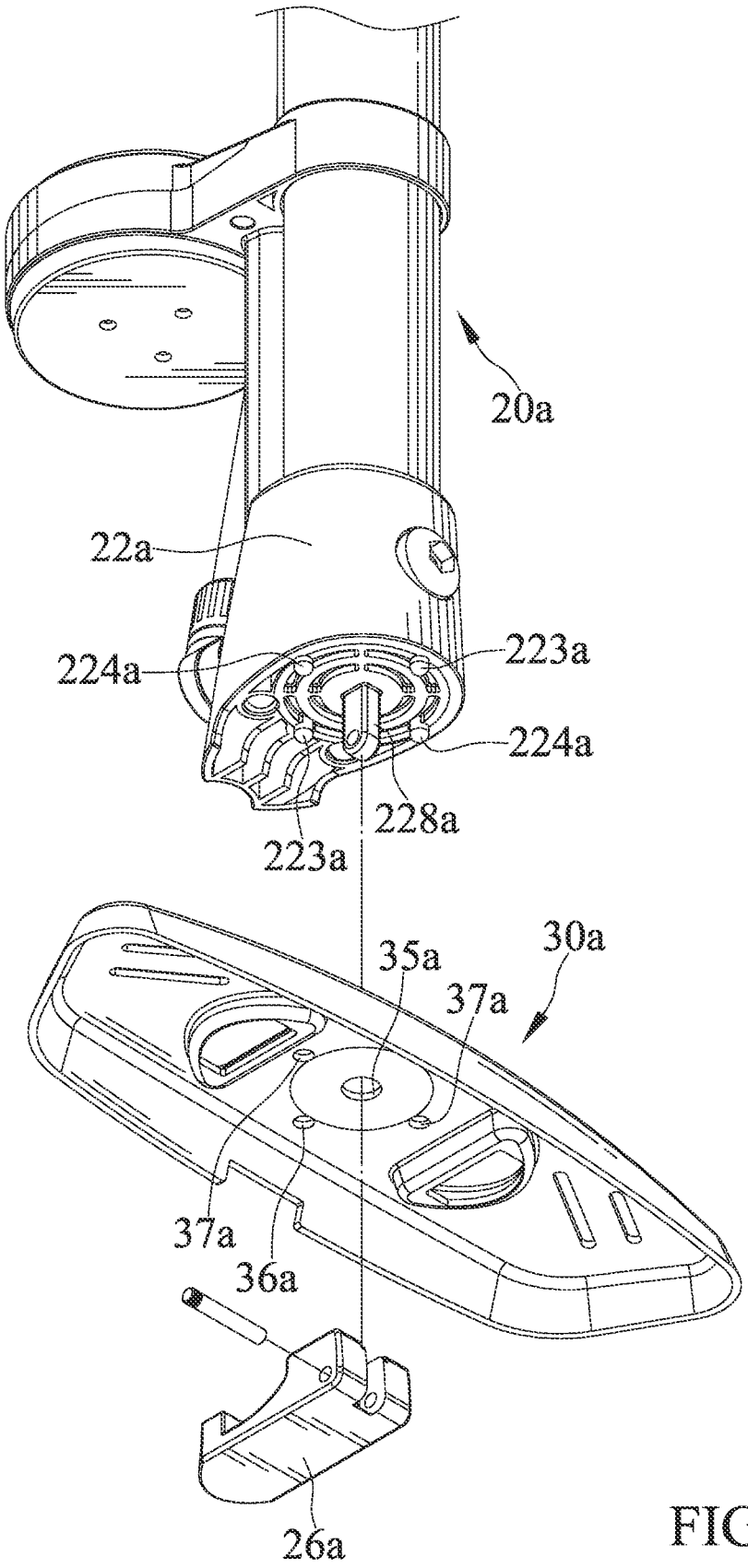
FIG. 10 is a partial, exploded, perspective view of a floor pump of a second first embodiment according to the present invention.
Figure 11:
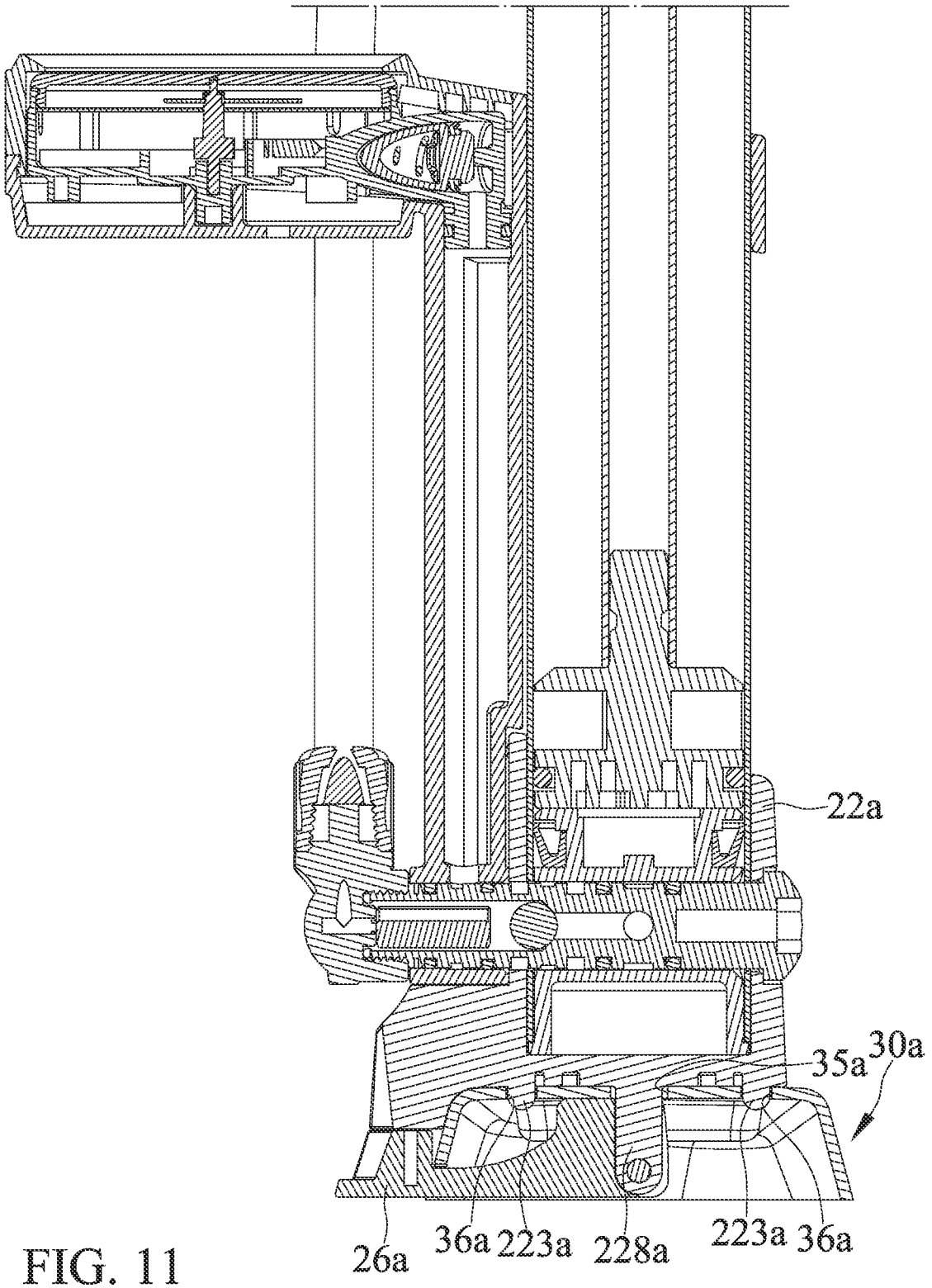
FIG. 11 is a partial, cross sectional view of the floor pump of the second embodiment according to the present invention, with a base of the floor pump in the extended position.
Figure 12:
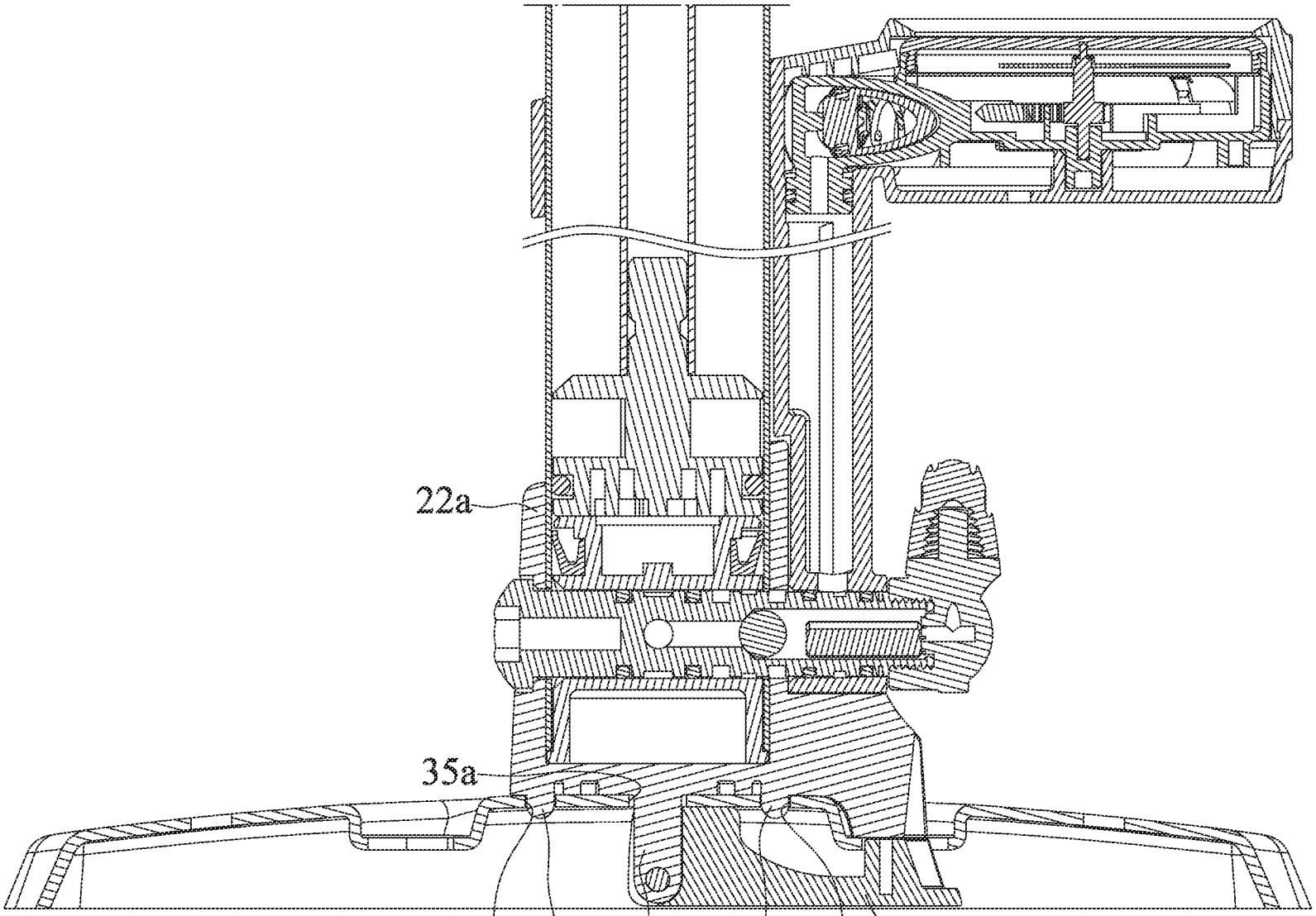
FIG. 12 is a cross sectional view illustrating the base of the floor pump of the second embodiment according to the present invention in the first folded position.

FIGS. 10-12 illustrate an exploded-perspective view and cross sectional views of a floor pump of a second embodiment according to the present invention. The second embodiment is substantially the same as the first embodiment, and the main difference therebetween is that the lower edge of the seat 22*a* in the vertical direction includes a positioning stub 228*a*. The base 30*a* includes a pivotal hole 35*a*. The positioning stub 228*a* extends through the pivotal hole 35*a*. The base 30*a* is pivotable about the positioning stub 228*a* between the extended position and the first folded position or between the extended position and the second folded position. The inflation device 20*a* includes a lever 26*a* disposed on a side of the base 30*a* opposite to the seat 22*a* and is pivotably mounted to the positioning stub 228*a*. When the lever 26*a* is in a tightened state, the lever 26*a* presses against the base 30*a* to retain the base 30*a* in the extended position, the first folded position, or the second folded position.

The lower edge of the seat 22*a* in the vertical direction includes two first positioning protrusions 223*a* and two second positioning protrusions 224*a*. The two first positioning protrusions 223*a* and the two second positioning protrusions 224*a* are equiangularly spaced from each other and around the positioning stub 228*a*. The two first positioning protrusions 223*a* are disposed on two opposite sides of the positioning stub 228*a*. The two first positioning protrusions 223*a* and the positioning stub 228*a* are on the same line. The two second positioning protrusions 224*a* are disposed on two opposite sides of the positioning stub 228*a*. The two second positioning protrusions 224*a* and the positioning stub 228*a* are on the same line. The upper edge of the base 30*a* in the vertical direction includes two first positioning holes 36*a* and two second positioning holes 37*a*. The two first positioning holes 36*a* and the two second positioning holes 37*a* are equiangularly spaced from each other and around the pivotal hole 35*a*. When the base 30*a* is in the extended position, the two first positioning protrusions 223*a* are respectively coupled in the two first positioning holes 36*a*, and the two second positioning protrusions 224*a* are respectively coupled in the two second positioning holes 37*a*. When the base 30*a* is in the first folded position or the second folded position, the two first positioning protrusions 223*a* are respectively coupled in the two second positioning holes 37*a*, and the two second positioning protrusions 224*a* are respectively coupled in the two first positioning holes 36*a*.

In view of the foregoing, the base 30, 30*a* of the floor pump 10 can be pivoted to the first or second folded position to reduce the volume for transportation or storage. The operation is simple and easy.

Although specific embodiments have been illustrated and described, numerous modifications and variations are still possible without departing from the scope of the invention. The scope of the invention is limited by the accompanying claims.

The invention claimed is:

1. A floor pump comprising:

an inflation device including a pump, a seat, and a pressure gauge, wherein the pump extends in a vertical direction, wherein the seat is connected to a lower edge of the pump in the vertical direction, wherein the pressure gauge is disposed in a horizontal direction and is connected between two ends of the pump in the vertical direction, wherein the seat includes an outer periphery having a coupling protrusion protruding outward in the horizontal direction;

a base pivotably connected to the seat and movable between an extended position, a first folded position and a second folded position, wherein the base includes a first footrest portion and a second footrest portion, wherein the first footrest portion and the second footrest portion are located on two opposite sides of the seat, wherein an upper edge of the base in the vertical direction includes a first coupling groove and a second coupling groove, wherein the first coupling groove is disposed between the first footrest portion and the seat, wherein the second coupling groove is disposed between the second footrest portion and the seat;

wherein when the base is in the extended position, both the first footrest portion and the second footrest portion are not located below the pressure gauge in the vertical direction, and the coupling protrusion abuts against an outer periphery of the base in the horizontal direction;

wherein when the base is in the first folded position, the first footrest portion is located below the pressure gauge in the vertical direction, and the coupling protrusion is coupled in the first coupling groove;

wherein when the base is in the second folded position, the second footrest portion is located below the pressure gauge in the vertical direction, and the coupling protrusion is coupled in the second coupling groove.

2. The floor pump as claimed in claim 1, wherein a fastener is connected to the lower edge of the seat in the vertical direction, wherein the base includes a pivotal hole, wherein the fastener extends from a side of the base opposite to the seat through the pivotal hole and is in threading connection with the seat, wherein the base is pivotable about the fastener between the extended position and the first folded position or between the extended position and the second folded position, and wherein when the fastener is tightened, the base is retained in the extended position, the first folded position, or the second folded position.

3. The floor pump as claimed in claim 2, wherein the lower edge of the seat in the vertical direction includes two first positioning protrusions and two second positioning protrusions, wherein the two first positioning protrusions and the two second positioning protrusions are equiangularly spaced from each other and around the fastener, wherein the two first positioning protrusions are disposed on two opposite sides of the fastener, wherein the two first positioning protrusions and the fastener are on a same line, wherein the two second positioning protrusions are disposed on two opposite sides of the fastener, wherein the two second positioning protrusions and the fastener are on a same line, wherein the upper edge of the base in the vertical direction includes two first positioning holes and two second positioning holes, wherein the two first positioning holes and the two second positioning holes are equiangularly spaced from each other and around the pivotal hole, wherein when the base is in the extended position, the two first positioning protrusions are respectively coupled in the two first positioning holes, and the two second positioning protrusions are respectively coupled in the two second positioning holes, and wherein when the base is in the first folded position or the second folded position, the two first positioning protrusions are respectively coupled in the two second positioning holes, and the two second positioning protrusions are respectively coupled in the two first positioning holes.

4. The floor pump as claimed in claim 1, wherein the lower edge of the seat in the vertical direction includes a positioning stub, wherein the base includes a pivotal hole, wherein the positioning stub extends through the pivotal hole, wherein the base is pivotable about the positioning stub between the extended position and the first folded position or between the extended position and the second folded position, wherein the inflation device includes a lever disposed on a side of the base opposite to the seat and is pivotably mounted to the positioning stub, and wherein when the lever is in a tightened state, the lever presses against the base to retain the base in the extended position, the first folded position, or the second folded position.

5. The floor pump as claimed in claim 4, wherein the lower edge of the seat in the vertical direction includes two first positioning protrusions and two second positioning protrusions, wherein the two first positioning protrusions and the two second positioning protrusions are equiangularly spaced from each other and around the positioning stub, wherein the two first positioning protrusions are disposed on two opposite sides of the positioning stub, wherein the two first positioning protrusions and the positioning stub are on a same line, wherein the two second positioning protrusions are disposed on two opposite sides of the positioning stub, wherein the two second positioning protrusions and the positioning stub are on a same line, wherein the upper edge of the base in the vertical direction includes two first positioning holes and two second positioning holes, wherein the two first positioning holes and the two second positioning holes are equiangularly spaced from each other and around the pivotal hole, wherein when the base is in the extended position, the two first positioning protrusions are respectively coupled in the two first positioning holes, and the two second positioning protrusions are respectively coupled in the two second positioning holes, and wherein when the base is in the first folded position or the second folded position, the two first positioning protrusions are respectively coupled in the two second positioning holes, and the two second positioning protrusions are respectively coupled in the two first positioning holes.

6. The floor pump as claimed in claim 1, wherein the seat includes two receptacles, two elastic elements, and two pressing members, wherein the two receptacles are disposed in the lower edge of the seat in the vertical direction, wherein the two elastic elements are respectively received in the two receptacles, wherein the two pressing members are respectively received in the two receptacles, wherein each of the two pressing members includes an end abutting against the seat and another end abutting against an associated pressing member, and wherein an end of each pressing member opposite to an associated elastic element abuts against the upper edge of the base in the vertical direction.

7. The floor pump as claimed in claim 1, wherein the inflation device includes an intercommunicating axle and an inflation tube, wherein the intercommunicating axle is inserted into the seat in the horizontal direction and extends through the pump, wherein the pressure gauge is connected to an intercommunicating tube, wherein an end of the intercommunicating tube opposite to the pressure gauge is mounted around the intercommunicating axle and is adjacent to the seat, wherein the inflation tube is in threading connection with an end of the intercommunicating axle and is located on a side of the intercommunicating tube opposite to the seat, and wherein the pump, the pressure gauge, and the inflation tube intercommunicate with each other.

8. The floor pump as claimed in claim 7, wherein the pump includes a cylinder and a bottom plug, wherein the bottom plug is disposed in an end of the cylinder, wherein the end of the cylinder is disposed in the seat, and wherein the intercommunicating axle is disposed in the seat and extends through the cylinder and the bottom plug.

* * * * *